United States Patent [19]

Carlson

[11] 4,113,604

[45] Sep. 12, 1978

[54] PROCESS FOR TREATING A SOUR PETROLEUM DISTILLATE WITH ANION EXCHANGE RESIN AND WITH METAL PHTHALOCYANINE CATALYST

[75] Inventor: David H. J. Carlson, Park Ridge, Ill.

[73] Assignee: UOP Inc., Des Plaines, Ill.

[21] Appl. No.: 799,825

[22] Filed: May 23, 1977

[51] Int. Cl.[2] ..... C10G 27/06

[52] U.S. Cl. ..... 208/206; 208/236; 208/289

[58] Field of Search ..... 208/192, 189, 206, 191, 208/236, 289

[56] References Cited

U.S. PATENT DOCUMENTS

| | | | |
|---|---|---|---|
| 3,108,081 | 10/1963 | Gleim et al. | 208/206 |
| 3,108,948 | 10/1963 | Ring | 208/189 |
| 3,130,148 | 4/1964 | Gleim | 208/206 |
| 3,144,403 | 8/1964 | Jacob | 208/189 |
| 3,392,111 | 7/1968 | Napier et al. | 208/189 |
| 3,454,488 | 7/1969 | Lewis et al. | 208/191 |
| 3,686,094 | 8/1972 | Laleuf et al. | 208/206 |

*Primary Examiner*—George Crasanakis

*Attorney, Agent, or Firm*—James R. Hoatson, Jr.; Robert W. Welch; William H. Page, II

[57] ABSTRACT

A catalytic process for treating a mercaptan-containing sour petroleum distillate is disclosed. The distillate is contacted with a weakly basic anion exchange resin to separate a portion of the mercaptan content and substantially all of the acidic catalyst toxins or toxin precursors. The resulting distillate is subsequently treated in contact with a supported metal phthalocyanine catalyst in admixture with an oxidizing agent and an alkaline solution to convert the residual mercaptans to innocuous disulfides.

7 Claims, No Drawings

PROCESS FOR TREATING A SOUR PETROLEUM DISTILLATE WITH ANION EXCHANGE RESIN AND WITH METAL PHTHALOCYANINE CATALYST

This invention relates to a catalytic process for treating a mercaptan-containing sour petroleum distillate contaminated with catalyst toxins and toxin precursors. Processes for the oxidation and conversion of mercaptans contained in a sour petroleum distillate wherein the distillate is treated in admixture with an oxidizing agent in contact with a metal phthalocyanine catalyst at oxidation reaction conditions, have become well known and widely practiced in the petroleum refining industry. Said processes are advantageously effected in a fixed bed treating system wherein the metal phthalocyanine catalyst is adsorbed or impregnated on a solid adsorbent support dispersed as a fixed bed in a treating or contact vessel. The distillate is passed in contact with the catalyst in admixture with an oxidizing agent and an aqueous caustic solution. The caustic solution is regenerated or replaced as it becomes spent through the accumulation of acidic and other non-hydrocarbon impurities, and the supported catalyst is reactivated utilizing, in most cases, relatively simple regeneration procedures.

In the treating of sour petroleum distillates, it has heretofore been the practice to initially treat the distillate in a liquid-liquid system in contact with a dilute aqueous caustic solution to separate a major portion of the mercaptans contained therein. The residual mercaptans are subsequently converted to innocuous disulfides, as heretofore described, and retained in the distillate.

It is an object of this invention to present an improved catalytic process for treating a sour petroleum distillate. It is a further object to present a novel process for the pretreatment of said distillate for the separation of a major portion of the mercaptan content thereof, and substantially all of the acidic catalyst toxins and toxin precursors.

In one of its broad aspects, the present invention embodies a catalytic process for treating a mercaptan-containing sour petroleum distillate contaminated with acidic catalyst toxins or toxin precursors which comprises contacting said distillate with a weakly basic anion exchange resin and recovering said distillate reduced in mercaptan content and substantially free of acidic catalyst toxins and precursors thereof; contacting the resulting distillate with a supported metal phthalocyanine catalyst in admixture with an oxidizing agent and an alkaline solution having a pH of from about 9 to about 14; and recovering the thus treated distillate substantially free of mercaptans.

One of the more limited embodiments comprises treating said mercaptan-containing distillate in contact with an amine anion-exchange resin comprising a porous styrene-divinylbenzene cross-linked polymer matrix and recovering said distillate reduced in mercaptan content and substantially free of acidic catalyst toxins and precursors thereof; contacting the resulting distillate with a supported cobalt phthalocyanine catalyst in admixture with air and a caustic solution having a pH of from about 9 to about 14; and recovering the thus treated distillate substantially free of mercaptans.

One of the more specific embodiments concerns a catalytic process for treating a mercaptan-containing sour petroleum distillate contaminated with acidic catalyst toxins or toxin precursors which comprises contacting said distillate with an amine anion-exchange resin comprising a porous styrene-divinylbenzene cross-linked polymer matrix and primary amine functional groups, and recovering said distillate reduced in mercaptan content and substantially free of acidic catalyst toxins and precursors thereof; contacting the resulting distillate with an activated charcoal-supported cobalt phthalocyanine monosulfonate catalyst in admixture with air and an aqueous caustic solution having a pH of from about 9 to about 14; and recovering the thus treated distillate substantially free of mercaptans.

Other objects and embodiments of this invention will become apparent in the following detailed specification.

Pursuant to the process of the present invention, a mercaptan-containing sour petroleum distillate is initially treated in contact with a weakly basic anion-exchange resin, the distillate being recovered substantially free of acidic catalyst toxins and toxin precursors, and containing a reduced mercaptan content. There are a variety of weakly basic anion-exchange resins suitable for use in accordance with the process of the present invention. The weakly basic anion-exchange resin will typically comprise primary, secondary and/or tertiary amine functional groups. Those anion-exchange resins comprising predominantly tertiary amine functional groups, for example dimethylaminomethyl functional groups, are among the more effective anion-exchange resins. Further, certain weakly basic anion exchange resins comprising cross-linked monoethylenically unsaturated monomer-polyvinylidene monomer copolymer matrices have desirable porosity and high surface area properties affording greater access to a larger number of functional groups. Cross-linked styrene-polyvinylbenzene copolymers are a notable example. Other monoethylenically unsaturated monomers, for example alpha-methylstyrene, mono- and polychlorostyrenes, vinyltoluene, vinylanisole, vinylnaphthalene and the like, have been disclosed as being copolymerizable with other polyvinylidene monomers, for example, trivinylbenzene, divinylnaphthalene, divinylethene, trivinylpropene, and the like, to form desirable cross-linked copolymer matrices. Amberlyst A-21, described as a weakly basic anion exchange resin comprising a cross-linked styrene-divinylbenzene copolymer matrix having tertiary amine functional groups is a preferred anion exchange resin. Anion exchange resins manufactured under the tradename Amberlyst A-29 and Duolite A-7 are exemplary of commercial anion exchange resins which can be employed. The former is described as an intermediate strength anion exchange resin, and the latter is described as a weakly basic anion exchange resin having secondary and tertiary amine functional groups.

The sour petroleum distillate is suitably treated in contact with the weakly basic anion-exchange resin at a temperature of from about 10° to about 100° C., and at a pressure of from about atmospheric to about 100 atmospheres to adsorb at least a portion of the mercaptan content of the sour petroleum distillate, and substantially all of the acidic catalyst toxins — principally phenolic materials which either function as catalyst toxins or are oxidizable to catalyst toxins during the subsequent catalytic oxidation of the residual mercaptans to disulfides as herein contemplated. The sour petroleum distillate is preferably maintained in contact with the weakly basic anion-exchange resin for a time equivalent to a liquid hourly space velocity of from about 0.5 to about 5. Regeneration of the anion-exchange resin can be effected periodically, as required, by conventional methods known to the art. Briefly, the resin is first rinsed with a solvent mutually miscible with the distillate, typically methanol, and regeneration is then effected by means of an aqueous caustic or ammoniacal solution passed over the resin. A final water rinse followed by a methanol rinse will usually precede further use.

In accordance with the present process, the sour petroleum distillate, substantially free of acidic catalyst toxins and toxin precursors, is further treated in contact with a supported metal phthalocyanine catalyst in admixture with an oxidizing agent and an alkaline solution having a pH of from about 9 to about 14. Treatment of the sour petroleum distillate in contact with the supported metal phthalocyanine catalyst, and in admixture with the alkaline solution and oxidizing agent, can be effected at a temperature of from about 10° to about 250° C. in accordance with prior art practice, and a pressure of from about atmospheric to about 100 atmospheres. A contact time equivalent to a liquid hourly space velocity of from about 0.5 to about 5 is suitable to effect the sweetening process.

The metal phthalocyanine catalyst employed herein can be any of the various metal phthalocyanines heretofore employed in the sweetening of sour petroleum distillates, especially the Group VIII metal phthalocyanines such as cobalt phthalocyanine, iron phthalocyanine, nickel phthalocyanine, platinum phthalocyanine, palladium phthalocyanine, rhodium phthalocyanine, ruthenium phthalocyanine, osmium phthalocyanine, iridium phthalocyanine, or mixtures thereof. Other metal phthalocyanines which may be used include magnesium phthalocyanine, titanium phthalocyanine, hafnium phthalocyanine, vanadium phthalocyanine, tantalum phthalocyanine, molybdenum phthalocyanine, manganese phthalocyanine, copper phthalocyanine, silver phthalocyanine, zinc phthalocyanine, tin phthalocyanine, and the like. The metal phthalocyanine is preferably employed as a derivative thereof, the commercially available sulfonated derivatives, for example, cobalt phthalocyanine monosulfonate, cobalt phthalocyanine disulfonate, or mixtures thereof, being particularly preferred. While the sulfonated derivatives are preferred, other derivatives, particularly the carboxylated derivatives may be employed. The catalyst support may comprise any of the various charcoals produced by the destructive distillation of wood, peat, lignite, nutshells, bones and other carbonaceous matter, and preferably such charcoals as have been heat treated and/or chemically treated to form a highly porous particle structure of increased adsorbent capacity, and generally defined as activated carbon or charcoal. Preferred activated charcoals for use as a catalyst support include vegetable-derived charcoals, lignite coal-derived charcoals, bituminous coal-derived charcoals, peat-derived charcoals, and petroleum black-derived charcoals. Such charcoals are exemplified by Nuchar, which is a charcoal derived from vegetable sources such as ground wood pulp and available from Westvaco Company; Hydrodarco charcoal (also known as Darco), which is derived from lignite coal and available from the Atlas Chemical Company; Norit charcoal, which is derived from peat and available from the Norit Company; Columbia charcoal, which is derived from petroleum black and available from Union Carbide Company; and Pittsburg charcoal, which is derived from bituminous coal and available from the Calgon Company.

Suitable metal phthalocyanine catalyst supports further include the naturally occurring clays and silicates, for example, diatomaceous earth, fuller's earth, kieselguhr, attapulgus clay, feldspar, montmorillonite, halloysite, kaolin, and the like, and also the naturally occurring or synthetically prepared refractory inorganic oxides such as alumina, silica, zirconia, thoria, boria, etc., or combinations thereof, like silica-alumina, silica-zirconia, alumina-zirconia, etc. Any particular solid adsorbent material is selected with regard to its stability under conditions of its intended use. For example, in the treatment of a sour petroleum distillate the solid adsorbent carrier material should be insoluble in, and otherwise inert to, the aqueous caustic solutions and the petroleum distillate at treating conditions. The supported metal phthalocyanine catalyst preferably comprises from about 0.0001 to about 10 wt. % metal phthalocyanine.

The sour petroleum distillates herein contemplated vary widely in composition depending on the source of the petroleum from which the distillate was derived, the boiling range of the distillate, and possibly the method of processing the petroleum to produce the distillate. The differences include the character and concentration of the acidic and other non-hydrocarbon impurities. The improved process of the present invention is especially advantageously used in the treatment of the higher boiling petroleum distillates including particularly kerosenes and jet fuels. These higher boiling sour petroleum distillates generally contain the more difficultly oxidizable mercaptans, that is, the caustic insoluble, highly hindered branched chain and aromatic thiols — especially the higher molecular weigh tertiary and polyfunctional mercaptans. In the latter case, the difficulty arises from the presence of the acidic and other non-hydrocarbon impurities, usually phenolic materials, which occur in greater concentration in the higher boiling distillates. These impurities, while not necessarily adsorbable on the supported catalyst per se, are readily adsorbable in the higher oxidation state induced at the oxidative treating conditions. Although the present process is particularly applicable to the treatment of the heavier petroleum distillates, it is understood that the process may also be used for the treatment of other lower boiling sour petroleum distillates including normally gaseous, gasoline, naphtha, etc., petroleum fractions.

The following examples are presented in illustration of one preferred embodiment of this invention and are not intended as an undue limitation on the generally broad scope of the invention as set out in the appended claims.

EXAMPLE I

In this example, one portion of a sour kerosine fraction set out in Table I below was shaken in a glass beaker in admixture with air and an aqueous caustic solution (pH 14) and in contact with a charcoal-supported cobalt phthalocyanine monosulfonate catalyst containing 150 mg of said phthalocyanine per 100 cc of charcoal.

TABLE I

| | |
|---|---|
| Total Sulfur, wt. % | 0.339 |
| Mercaptan Sulfur, wt. ppm. | 930 |
| Hydrogen Sulfide Sulfur, wt. ppm. | <1 |
| Copper, mg/liter | 0.055 |
| Acid No.[1] mg KOH/g sample | 0.026 |
| Saybolt Color[2] | +14 |
| API Gravity at 60° F. | 42.5 |

TABLE I-continued

| | |
|---|---|
| Specific Gravity at 60° F. | 0.8132 |
| Distillation | |
| IBP, ° F. | 354 |
| 10 | 372 |
| 30 | 385 |
| 50 | 399 |
| 70 | 416 |
| 90 | 441 |
| 95 | 458 |
| EBP, ° F. | 486 |

[1]Acid No. is determined by titration with potassium hydroxide.
[2]Saybolt Color is measured as received.

The kerosine fraction was shaken in admixture with the air and caustic solution in contact with the catalyst for about 120 minutes. Samples were recovered periodically and analyzed for mercaptans, the analysis being set out in Table II below.

EXAMPLE II

In this example, a 200 cc portion of the sour kerosine fraction set out in Table I above was pretreated in accordance with the process of this invention. Thus, the sour kerosine fraction was percolated downwardly through a column containing 100 cc of a weakly basic anion exchange resin (Amberlyst A-21) in the form of porous 0.4–0.55 mm beads. The weakly basic anion exchange resin had an average pore diameter in the 700–1200 A range and a surface area in the 20–30 $m^2/gm$ range. The kerosine was processed over the resin at about 1 liquid hourly space velocity. The pretreated sour kerosine fraction was then further treated as described in Example I, the mercaptan analyses being set out in Table II below for comparison with that of Example I.

TABLE II

| | Kerosine Mercaptan Sulfur, ppm. | |
|---|---|---|
| Mixing Time, min. | Example I | Example II |
| 0 | 930 | 441 |
| 60 | 30 | 6 |
| 120 | 21 | 2 |

I claim as my invention:

1. A catalytic process for treating a mercaptan-containing sour petroleum distillate contaminated with acidic catalyst toxins or toxin precursors which comprises:

(a) contacting in a first step said distillate with an anion exchange resin comprising a porous styrene-divinylbenzene cross-linked polymer matrix having tertiary amine functional groups and recovering said distillate reduced in mercaptan content and substantially free of acidic catalyst toxins and precursors thereof;

(b) contacting in a second step said resultant distillate from step (a) with a supported metal phthalocyanine catalyst in admixture with an oxidizing agent and an alkaline solution having a pH of from about 9 to about 14; and (c) recovering the thus treated distillate from step (b) substantially free of mercaptans.

2. The process of claim 1 further characterized with respect to step (b) in that said contact is effected at a temperature of from about 10° to about 100° C. and at a pressure of from about atmospheric to about 100 atmospheres.

3. The process of claim 1 further characterized with respect to step (b) in that said contact is effected at a temperature of from about 10° to about 250° C. and at a pressure of from about atmospheric to about 100 atmospheres.

4. The process of claim 1 further characterized with respect to step (b) in that said alkaline solution is an aqueous caustic solution.

5. The process of claim 1 further characterized with respect to step (b) in that said metal phthalocyanine catalyst comprises cobalt phthalocyanine.

6. The process of claim 1 further characterized with respect to step (b) in that said supported metal phthalocyanine catalyst is an activated charcoal-supported metal phthalocyanine catalyst.

7. The process of claim 1 further characterized with respect to step (b) in that said supported metal phthalocyanine catalyst is an activated charcoal-supported cobalt phthalocyanine monosulfonate catalyst.

* * * * *